United States Patent [19]

Kamp

[11] Patent Number: 5,016,434

[45] Date of Patent: May 21, 1991

[54] RING SPINNING AND SPOOLING FRAME

[75] Inventor: Heinz Kamp, Wegberg, Fed. Rep. of Germany

[73] Assignee: W. Schlafhorst AG & Co., Monchen-Gladbach, Fed. Rep. of Germany

[21] Appl. No.: 405,640

[22] Filed: Sep. 11, 1989

[30] Foreign Application Priority Data

Sep. 10, 1988 [DE] Fed. Rep. of Germany ..... 3830852

[51] Int. Cl.[5] ..... D01H 7/00; D01H 9/00

[52] U.S. Cl. ..... 57/313; 57/266; 242/35.5 R

[58] Field of Search ..... 57/313, 266, 276–278, 57/75; 242/35.5 R, 35.5 A, 35.5 T

[56] References Cited

U.S. PATENT DOCUMENTS

| | | | |
|---|---|---|---|
| 1,060,233 | 4/1913 | Crompton | 57/313 X |
| 2,632,612 | 3/1953 | Stange | 57/266 X |
| 3,391,527 | 7/1968 | Kato | 57/313 |
| 3,410,078 | 11/1968 | Freedman et al. | 57/313 X |
| 3,903,681 | 9/1975 | Bous | 57/313 |

*Primary Examiner*—Stanley N. Gilreath

*Attorney, Agent, or Firm*—Herbert L. Lerner; Laurence A. Greenberg

[57] ABSTRACT

A ring spinning and spooling frame includes spooling stations. A plurality of spindles are disposed in pairs on bearing plates. At least two of the pairs of the spindles are associated with one of the spooling stations. The bearing plates are movable in position between a ring spinning position and an unreeling swiveled position of the spindles. An apparatus which carries the bearing plates pivots one of the bearing plates through 180° out of the vicinity of adjacent bearing plates between the ring spinning position and the unreeling swiveled position of the spindles.

16 Claims, 6 Drawing Sheets

RING SPINNING AND SPOOLING FRAME

The invention relates to a ring spinning and spooling frame having a multiplicity of spindles which are combined in pairs that are each on one bearing plate, the spindles can be brought out of the ring spinning position into an unreeling position and vice versa through a change in position of the bearing plate.

Ring spinning machines or frames spin the yarn onto so-called spinning bobbins, which contain only a small quantity of yarn and on which the yarn still has some irregularities. Accordingly, they cannot be used in that condition on machines that produce flat textile articles. For this reason, a plurality of spinning bobbins are rewound in succession onto a large cross-wound bobbin or cheese on a separate spooling frame, and the yarn is cleaned in the process. Such an operation necessitates labor-intensive handling of the spinning bobbins, from doffing them at the spinning frame and transporting them to the spooling frame by means of a special transport system, to preparing them at preparation stations and unreeling them, and finally returning the spinning tubes to the spinning frame, checking the spinning tubes, and placing the empty spinning tubes back on the spindles.

Proposals have already been made for performing the rewinding of the spun yarn from the spinning bobbins onto cheeses on the ring spinning machines themselves. A ring spinning frame having a mobile spooling apparatus is known from U.S. Pat. No. 3,391,527. In that device, a spooling apparatus travels along the ring spinning frame and rewinds the finished spinning bobbins onto a cheese. The spindles stand upright beside one another or one after the other in pairs on a carrying system, with one spindle in the spinning position and the other in the spooling position. The spindles which are lined up one after the other must each be rotated along with the carrying system in a horizontal plane in order to change positions. Due to the disposition of the spinning and spooling position, a spindle spacing which is known from conventional spinning machines cannot be maintained on this machine. This increases the amount of space needed.

It is accordingly an object of the invention to provide a ring spinning and spooling frame, which overcomes the hereinafore-mentioned disadvantages of the heretofore-known devices of this general type and which provides a ring spinning and spooling frame which is constructed in such a way that a high spinning output is attained while requiring less floor space.

With the foregoing and other objects in view there is provided, in accordance with the invention, a ring spinning and spooling frame, comprising spooling stations, bearing plates, a plurality of spindles disposed in pairs on each of the bearing plates, at least two of the pairs of the spindles being associated with one of the spooling stations, the bearing plates being movable in position between a ring spinning position and an unreeling swiveled position of the spindles, and an apparatus carrying the bearing plates, the apparatus pivoting one of the bearing plates through 180° out of the vicinity of adjacent bearing plates or other hindering machine parts between the ring spinning position and the unreeling swiveled position of the spindles.

The bearing plates each carry one pair of spindles. In order to carry out the change in position of the spindle pairs, the bearing plates are moved out of the way of the adjacent bearing plates or interfering machine parts by an apparatus that simultaneously carries the bearing plates. In this pivoted position, the bearing plates are pivotable about an angle of 180½, in order to change the position of a spindle in the ring spinning position to the unreeling position. Advantageously, this makes it possible to avoid exceeding the minimum possible spacing provided on conventional ring spinning machines, so that the floor space is perceptibly reduced as compared with known ring spinning and spooling frames. The effectiveness of the ring spinning and spooling frame can be substantially further increased by associating at least two spindle pairs with each spooling station. Since the spooling speed is substantially greater than the spinning speed (the spinning speed may be between 18 and 24 meters per minute (m/min), while the spooling speed is advantageously approximately 120 m/min), it is possible to wind up two spinning bobbins in succession onto one cheese, while two spinning bobbins are being wound at a time. The association need not be restricted to two pairs of ring spindles. The criterion is to make maximum use of a spooling station.

Due to the lower spooling speed by comparison with the conventional spooling frame, a uniform yarn tension is advantageously attained over the entire unreeling operation, especially at the end of the unwinding of the spinning bobbin. This provision makes for an even buildup of the cheese on a ring spinning and spooling frame according to the invention.

In accordance with another feature of the invention, there are provided yarn cleaners each being associated with a respective one of the spooling stations, and splicers each being associated with a respective one of the yarn cleaners. The yarn cleaner detects any flaws arising during spinning and removes them from the yarn. The splicer makes it possible to splice broken yarns and to produce a yarn joint between the yarn of the cheese and the yarn of the spinning bobbin to be unreeled after a change in the spinning bobbin. As a result, cheeses that can be used immediately are obtained on the spinning machine.

In accordance with a further feature of the invention, there is provided a removal apparatus for cheeses being associated with the spooling stations. The removal apparatus may be a conveyor belt traveling past the spooling station. The finished cheeses are deposited on this conveyor belt and can thus be taken immediately to the location at which they will be used.

In accordance with an added feature of the invention, there are provided pivot shafts each being connected to a respective one of the bearing plates, the spindles of each spindle pair being disposed on one of the bearing plates symmetrically opposite one another with respect to the pivot shaft of the one bearing plate, and the spindles in the spooling position being rotated through 180° under the spindles in the spinning position. A configuration in which the two spindles are in a vertical alignment with one another on the bearing plate is advantageous. The spindle in the spooling position has its top pointing downward, so that the yarn is unreeled overhead, downward from the bobbin. Placing the spinning and spooling stations one below the other provides optimal yarn travel and a particularly space-saving configuration of the spinning and spooling equipment. Moreover, this makes the entire yarn travel in both the spinning and the spooling region completely accessible and monitorable.

In accordance with an additional feature of the invention, the two pairs of the spindles are associated with one of the spooling stations, and only one of the spindles in the spooling position of the two spindle pairs is connected with the associated spooling station for spooling. If a common spooling station is associated with two or more pairs of spindles, then one of the spindles in the spooling position is always operatively connected with the spooling station.

It is only after the spinning spool of these spindles has been unreeled that the next spindle in the spinning position enters into operative connection with the spooling station. The order in which the spindles are unreeled can advantageously be directed to the earliest instant at which one of a pair of spindles was swiveled into the spinning position.

In accordance with yet another feature of the invention, each of the spooling stations is disposed beneath and centrally or approximately centrally between the spindles in the spooling position associated with the spooling station. As a result, the yarn tension at the spooling stations is the same for two spindles which are associated with these stations and are located in the spooling position. The yarn guidance is effected by placing the spooling station in such a way that the oncoming angle of the yarns from the unreeling spinning station to the spooling station is of equal magnitude at any time, regardless of which of the spindles is just then being unreeled. The equality in the size of the oncoming angle has a particularly favorable effect in terms of a uniform yarn tension.

In accordance with yet a further feature of the invention, there are provided means for actuating the apparatus for outward and inward displacement as well as swiveling of the bearing plates carrying the spindles. This apparatus is constructed in such a way that the spindles are displaceable in a horizontal plane and rotatable in a vertical plane in a pivoting position. As a result, it is possible to displace the spindles with their bearing plates frontward out of the machine and out of range of the adjacent spindles, with the spindles being separated from the drive mechanism in the spinning position, or the drive mechanism being shut off in the case of individual drives. The outward displacement of a pair of spindles extends far enough that it can be swiveled past the other spindle pairs when pivoting in a vertical plane about 180°. Due to a retraction of the bearing plate of the spindle pair to the initial position, the unreeled spindle is moved into the spinning position and coupled with the drive mechanism, while the full spinning spool enters the spooling position and is unreeled there. In order to provide a change in position of the spindles of one pair of spindles, the spinning rail must be raised outward beyond the spindles. For this reason, a change in position as a rule is performed in groups for all of the spindle pairs of one machine, with the ring rail raised.

Since the bearings of the spindles of one spindle pair beside the other are disposed to the right and left of the pivot shaft of the apparatus, the spindles of one pair are always in the same spinning or unreeling position during spinning and unreeling, as the case may be.

In accordance with yet an added feature of the invention, the actuating means are in the form of a control shaft having offset control cams successively acting upon at least one or groups of the apparatus.

In accordance with yet an additional feature of the invention, the control cams of the control shaft are mutually offset by 120° and are operatively connected to the apparatus of every third spindle pair. Due to the 120° offset of the control cams on the central control shaft, the apparatus of the first, fourth and seventh spindle pair, as well as every subsequent third position for the other spindle pairs, are actuated by the first device on the left side of a two-sided spinning and spooling machine. Next, the actuation of the apparatus of the spindle pairs in the second, fifth, eighth and every third position thereafter on the opposite side of the machine takes place. Then, positions three, six and nine and every third position thereafter on the left side are actuated; then the positions one, four, seven and every third one after them on the right side, and finally the positions two, five, eight and every third one after them on the left are next, and so on. A 120° offset configuration of the control cams assures that the positions of the spindles will not be changed simultaneously at all of the spinning and spooling stations. This reduces the load on the control shaft. Additionally, this means that adjacent spindle pairs cannot hinder one another in the swiveling operation. Due to the sequence over time of the grouped change in position of the spindle pairs, the required splicing by the mobile splicer can be controlled in such a way that the splicing operation begins first at the spooling stations of the group having the earliest position change.

Naturally, it is also possible to provide a separate splicer for each spooling station, so that the spooling operations can be begun without delay at every spooling station.

Each apparatus of one spindle pair can also be equipped with an individual drive mechanism and thus triggered individually as needed by a control device.

In accordance with a concomitant feature of the invention, the spindles of the spindle pairs are constructed in such a way that they can be equipped with spinning tubes. Equipping them with spinning tubes has the advantage that if it becomes impossible to unreel the remainder of a yarn package completely, then the spinning tube with the remaining yarn can be removed from that spindle. The removed tube is replaced with a new one, so that joining of the yarn can be carried out at this spindle without time-consuming cleaning work, which occupies space on the surface of the spindle. If the spinning and spooling course is normal, the tube remains on the spindles.

Other features which are considered as characteristic for the invention are set forth in the appended claims.

Although the invention is illustrated and described herein as embodied in a ring spinning and spooling frame, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a fragmentary, diagrammatic, perspective view of a two-sided embodiment of a ring spinning and spooling machine according to the invention;

FIG. 1*a* is a fragmentary front-elevational view showing the yarn travel at a spooling station;

Figure 1:
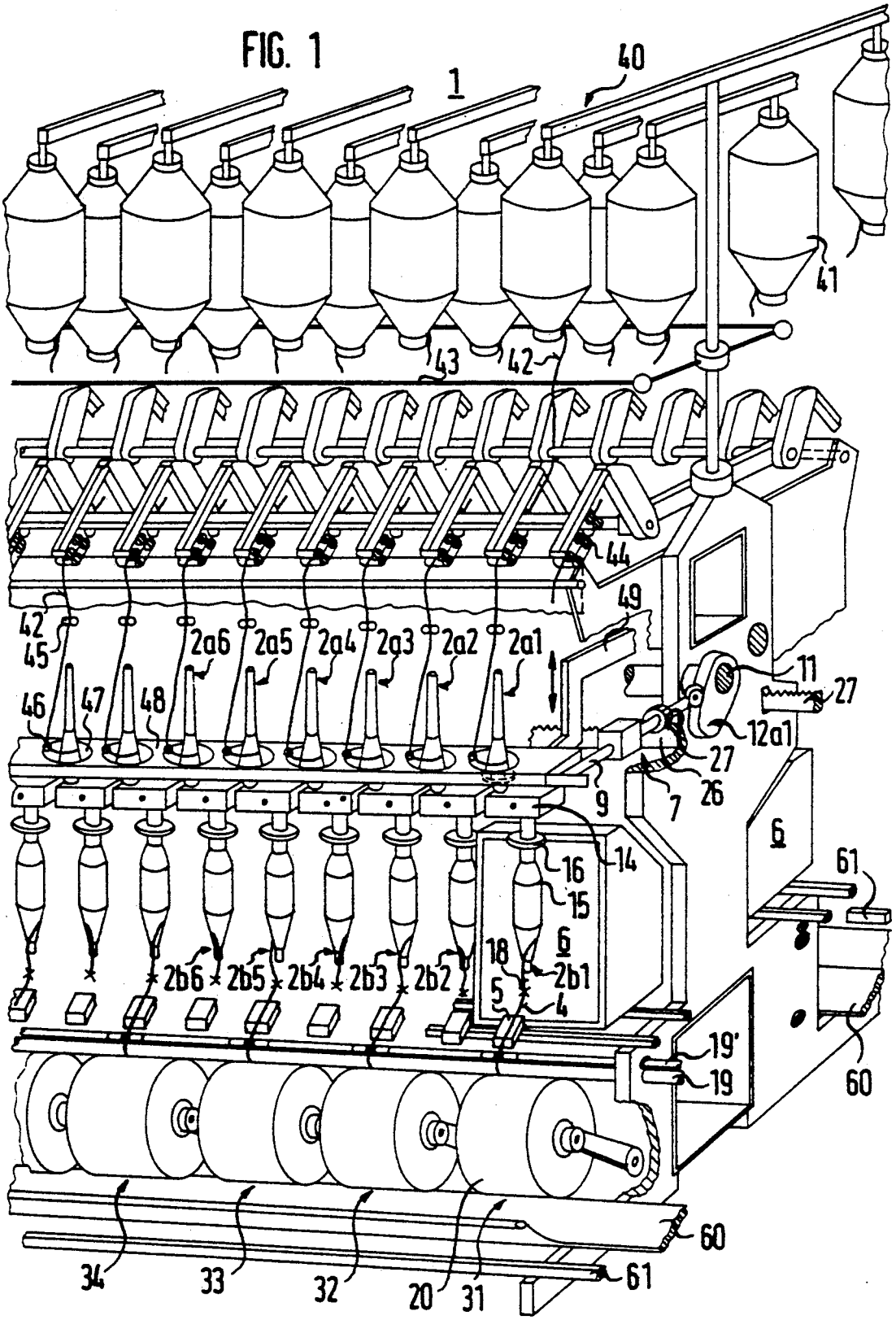

Referring now to the FIGURES of the drawing in detail and first, particularly, to FIG. 1 thereof, there is seen a ring spinning and spooling frame 1 according to the invention, on which roving 42 is supplied from a creel 40 of speed frame or flyer bobbins 41 through a roving guide strip 43 to a drawing system 44. The roving travels from a guide eyelet 45, through a traveler 46 on a ring 47 and is spun onto spindles 2*a*1, 2*a*2, 2*a*3, etc.. The ring 47 is located on a ring rail 48, which carries the rings of all of the spinning stations. An apparatus 49, which is not shown herein in further detail, provides for the raising and lowering of the ring rail in a known manner.

The ring spinning and spooling frame according to the invention can be constructed as a one-sided or two-sided frame. If the spinning and spooling units are disposed on one side and have a corresponding drawing system, sliver can also be drawn from cans.

Figure 2:
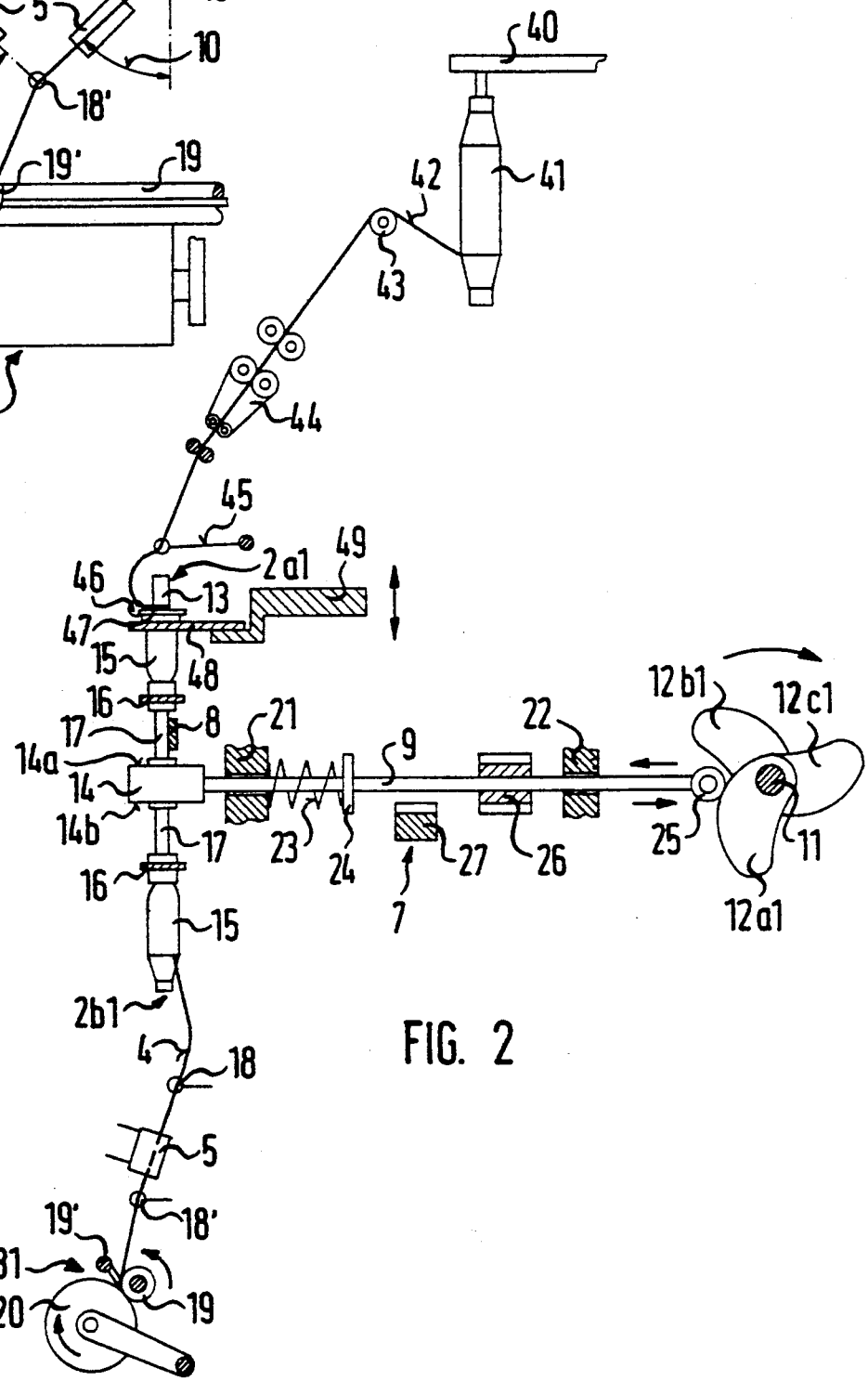
FIG. 2 is a diagrammatic, side-elevational overview of the functional elements of a spinning and spooling station of one spindle pair.
Figure 3:
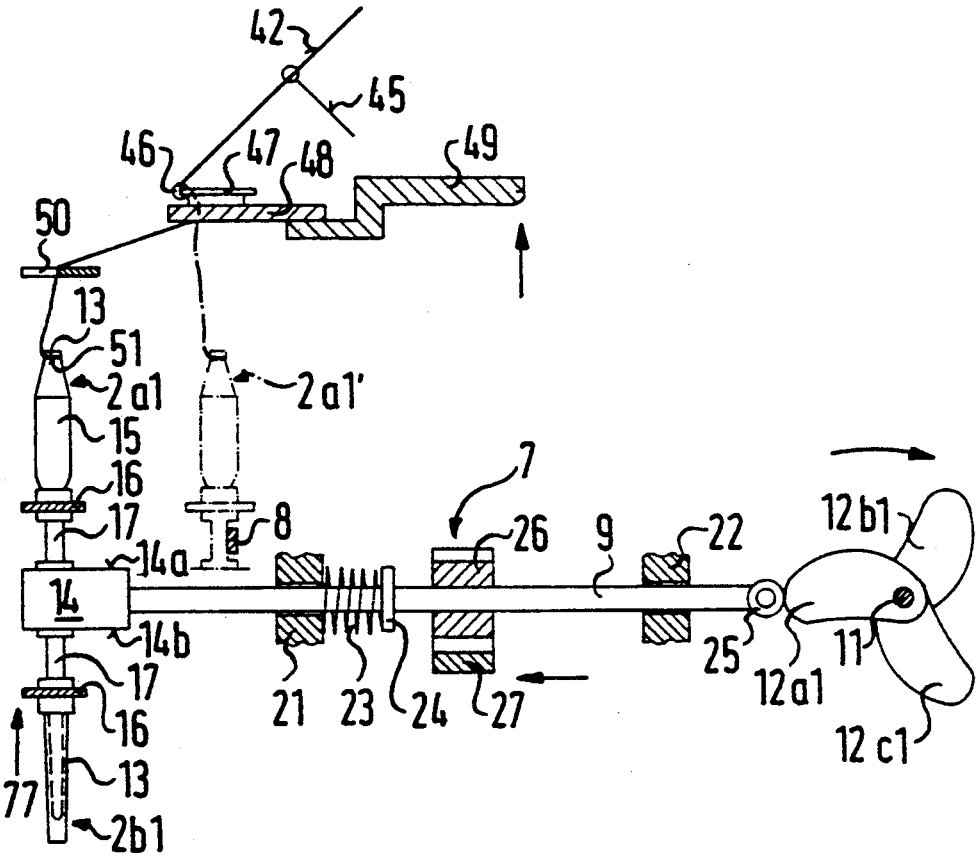
FIG. 3 is a view similar to FIG. 2 of the structure of an apparatus for displacing and swiveling the bearing plates.

Two adjacent spindles, for example the spindles 2*a*1 and 2*b*1, are combined into one spindle pair at a time. The bearings of a spindle pair, for example a bearing 14*a* of the spindle 2*a*1 and a bearing 14*b* of the spindle 2*b*1 shown in FIGS. 2 and 3, are located beside one another on a bearing plate 14 to the right and left of a pivot shaft 9 of the apparatus identified overall by reference numeral 7, with which the position change of the spindles is performed. The spindle 2*a*1 of the spindle pair is in the spinning position, while the spindle 2*b*1 is in the spooling position, rotated downward from its spindle partner through 180°. Further details of the structure of a spindle pair can also be seen in FIG. 2.

The spindles are equipped with spinning tubes 13, on which a package 15 of the yarn that is spun in a known manner, is located.

The bottom end of each spindle is equipped with a yarn catch ring 16, having a function which will be explained below. A drive wharve 17 is located under the yarn catch ring 16. In the spinning position, as seen for the spindle 2*a*1, this drive wharve rests on a drive mechanism. In the present exemplary embodiment, the drive mechanism is in the form of a tangential belt 8 extending along the spinning stations.

Yarn 4 to be unreeled travels from the spindle 2*b*1 in the spooling position, through a yarn guide eyelet 18 into a yarn cleaner 5, which simultaneously monitors the yarn quality as well. The yarn travels from the yarn cleaner 5 through the yarn guide eyelet 18' onto a winding package of a bobbin 20 at a spooling station 31 The bobbin 20 is driven by a winding roller 19, and the yarn 4 is laid down on the yarn package by means of a centrally controlled yarn guide 19'. It is also possible to drive the bobbin with a yarn guide drum.

Figure 1A:
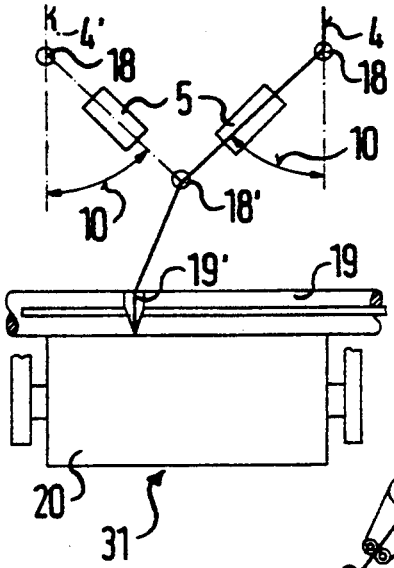

FIG. 1*a* is a fragmentary view showing the yarn travel at one spooling station, in this case the spooling station 31, with which two spindles having spinning bobbins are associated in the unreeling position. In order to ensure that the yarn tension at the yarn guide will be the same no matter which spinning bobbin is being unreeled at the moment, the spooling station is located centrally or approximately centrally between the associated spindles located in the spooling position. For instance, the yarn 4 may travel from the spindle 2*b*1 through the yarn guide eyelet 18, the yarn cleaner 5, and the centrally disposed yarn guide eyelet 18' and from there to the yarn guide 19', which lays down the yarn on the wound package of the bobbin 20.

Once the spindle 2*b*1 is unreeled, the spindle 2*b*2 follows next. The yarn travel 4' from the spindle 2*b*2 is shown in phantom. Once again, the yarn travels through a yarn cleaner 5 to the centrally disposed yarn guide eyelet 18'. As can be seen, the oncoming angle 10 of the yarn is of equal size in both cases. As a result, the yarn tension at the yarn guide 19' is always of equal magnitude as well, regardless of from which spinning bobbin the unreeling is being carried out at the moment.

In FIG. 2, the structure of the apparatus 7 for changing the position of the spindles by pivoting and displacing the bearing plate 14 is shown. FIG. 3 shows the apparatus 7 for pivoting and displacing the bearing plates in the actuated state. The bearings of the spindles, that is, the bearing 14*a* of the spindle 2*a*1 and the bearing 14*b* of the spindle 2*b*1, are located beside one another to the right and left of the pivot shaft 9 of the apparatus 7. The pivot shaft 9 extends as far as a centrally driven control shaft 11. In the ring spinning and spooling frame the pivot shaft 9 is supported in bearings 21 and 22. A spring 23, which is supported on the bearing 21 and on a flange 24 that is firmly connected to the pivot shaft 9, presses a roller 25 provided at the end of the pivot shaft 9 against the contour of a control cam 12*a*1 on the control shaft 11. The control cam 12*a*1 and further control cams 12*b*1 and 12*c*1 which can be seen on the control shaft 11, are mutually offset by an angle of 120°. As cannot be seen in this case, the control shaft continues, extending all of the way through the entire machine. Other control cams which surround the control shaft 11 in a spiral configuration, are hidden by the three control cams shown in this case.

If the centrally disposed control shaft 11 rotates clockwise, as indicated by the arrow, the control cam 12*a*1 pushes the pivot shaft 9 to the left in the direction of the arrow. During that process, a gear wheel 26 secured on the pivot shaft 9 comes to mesh with a rack 27. Due to actuation of the rack 27, the spindles can be rotated through 180°. If the control cam 12*a*1 rotates further beyond the horizontal position, the roller 25 follows the contour of the control cam 12*a*1, and the spring 23 presses the pivot shaft 9 through the flange 24 and turns spindles back again. The pivot shaft 9 returns to its initial position, and the spindles each assume the spinning and spooling position, respectively.

In FIG. 3, the spindles 2*a*1 and 2*b*1 are shown as being advanced in their swiveled position 77. A spinning position 2*a*1' of the spindle 2*a*1 is shown in phantom. In this position, the drive wharve 17 still rests on the drive belt 8.

The ring rail 48 has already been raised in the direction of the arrow past the upper end of the spindle 2*a*1 by the apparatus 49 for raising and lowering or hoisting the ring rail. At the same time, the guide eyelet 45 for the roving 42 has been swiveled upward. The yarn reserves required for the turning operation are deposited on the top of the spinning tube 13 in the form of a top winding 51. The spindle 2*b*1 has already been unreeled, and the spinning tube 13 is ready to receive a new spinning yarn.

If the spindle 2a1 is raised from the drive belt 8 by the pivot shaft 9 through the action of the control cam 12a1, then the spindle 2a1 is stopped. The guide eyelet 45, which is pivoted upward, clamps the roving. In the swiveled position 77, a draw-off eyelet 50 is pivoted over the spindle 2a1 and carries the yarn in the swiveling operation, so that the yarn reserve in the swiveling operation can unwind from the top winding.

If the spindle 2a1 is swiveled into the spooling position, then the yarn reserve stored in the form of the top winding 51 is unreeled, and once the swiveling operation is completed the yarn is located in the yarn catch ring 16 of the spindle 2b1 which is pivoted into the spinning position.

Once the pivoting operation is complete, the central control shaft 11 rotates onward in the clockwise direction, and the spindles are pulled into the spinning and spooling position by the pivot shaft 9. The draw-off eyelet 50 is pivoted out of the way of the yarn travel. Therefore, element 11 provides means for actuating the apparatus 7 for outward and inward displacement as well as swiveling of the bearing plates 14 carrying the spindles.

The swiveling operation will now be described once again, referring to FIGS. 4a–4f, which show a front view of the spindles.

Figure 4A:
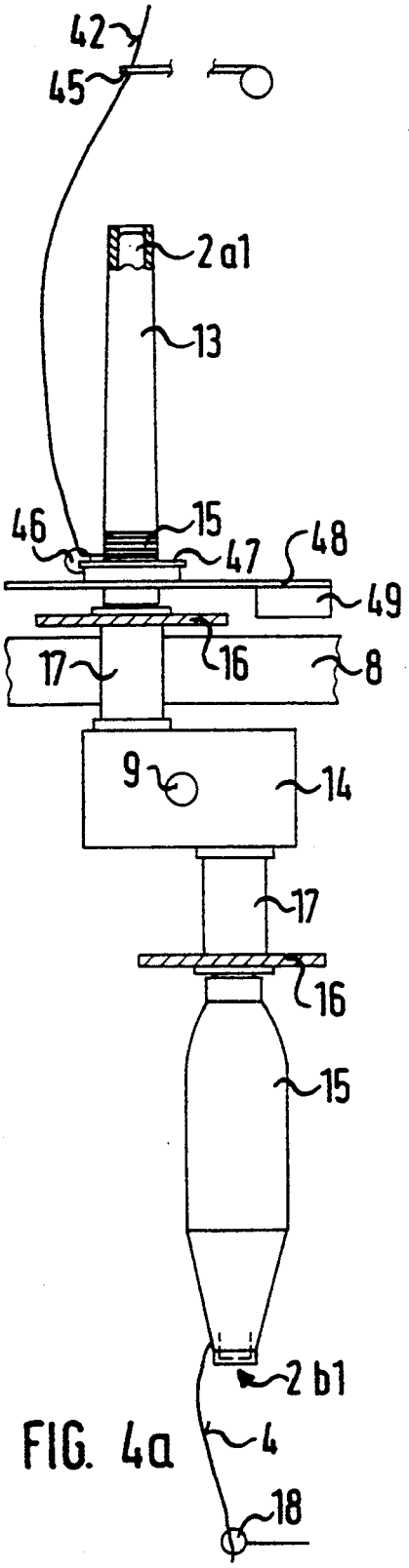
FIGS. 4*a*–4*f* are enlarged, fragmentary front-elevational views showing the swiveling operation for one spindle pair.

FIG. 4a shows how a yarn package 15 is spun in a known manner onto the spinning tube 13 of the spindle 2a1, while the spindle 2b1 is in the spooling position, with its yarn package 15 being unreeled and the yarn 4 being delivered to the spooling station 31, which is not shown.

Figure 4B:
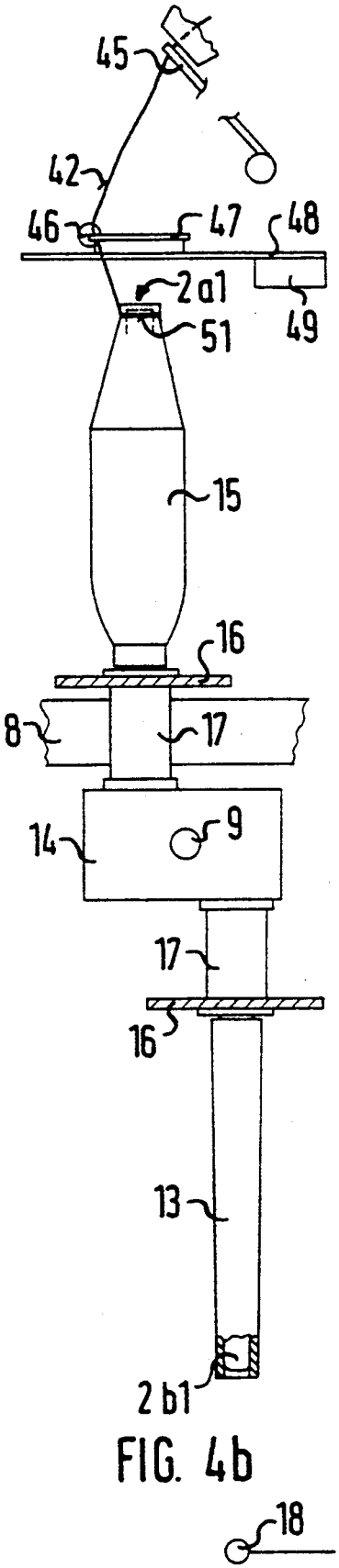

FIG. 4b shows the condition in which the spindle 2a1 has been spun until full, while the entire yarn package has been unreeled from the spinning tube 13 of the spindle 2b1. The ring rail 48 is raised above the spindle 2a1 by the apparatus 49, and a top winding 51 has been deposited at the end of the spinning tube. The guide eyelet 45 is pivoted upward, and the roving 42 is clamped.

Figure 4C:
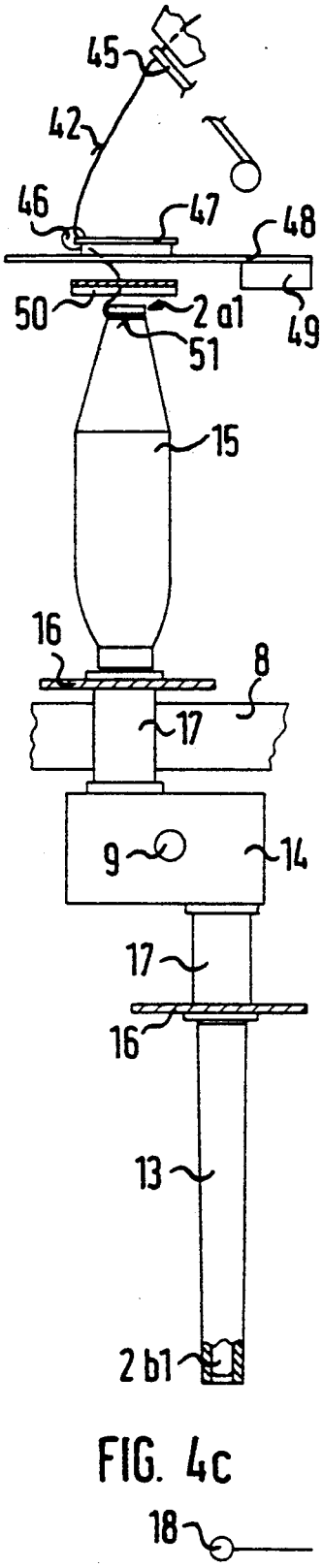

In FIG. 4c, the draw-off eyelet 50 has been thrust between the ring rail 48 and the spindle 2a1. At that instant, the spindles 2a1 and 2b1 have been displaced frontward with their bearing plate 14 out of the spinning and spooling positions toward the observer, through the control cams of the central control shaft. The drive wharve 17 is lifted from the tangential belt 18 in this process.

Figure 4D:
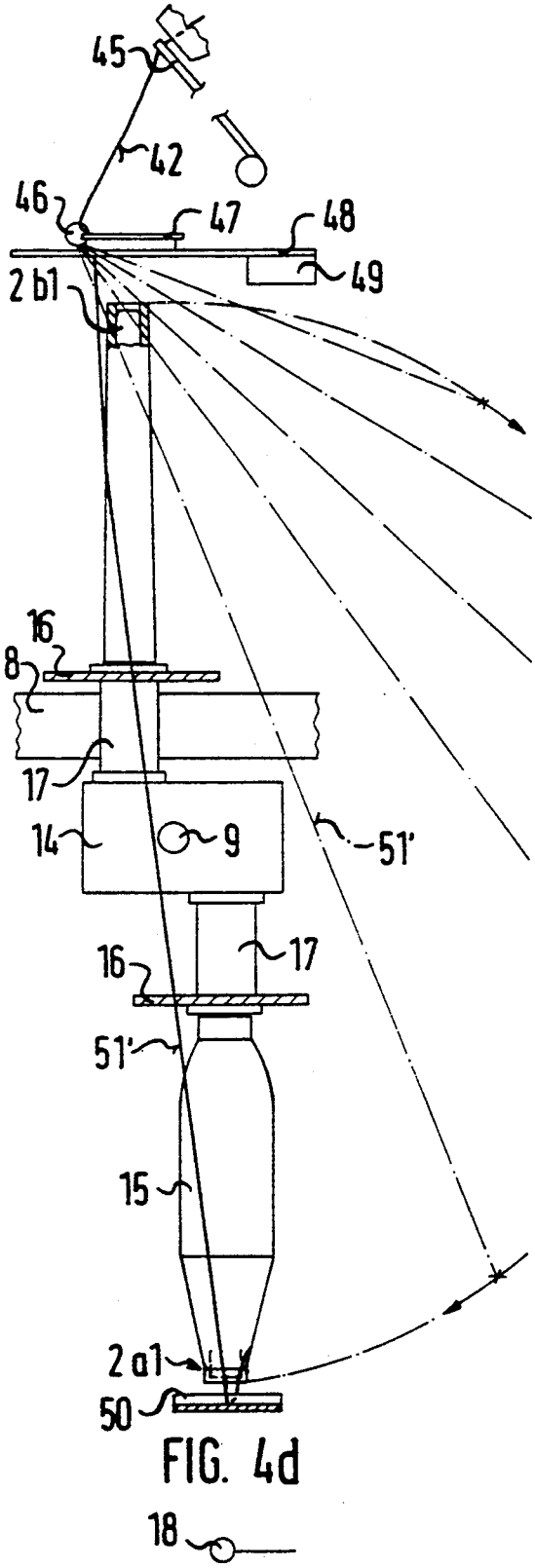

In FIG. 4d, the swiveling of the two spindles into the new positions is shown. During the swiveling operation, the top winding 51 is unwound in the form of a yarn 51', since the draw-off eyelet 50 pivots upward as well, above the spindle 2a1. Beginning at the traveler 46, the yarn 51' travels in the form of a chord of the semicircle of the pivoting draw-off eyelet 50, while lengthening continuously, until the point where the spindle 2a1 is located in front of its unreeling position. The yarn 51' is then diagonally above the pivoted spindle 2b1, which is in front of the spinning position and the spindle 2a1, which is in front of the spooling position. The yarn 51, is caught by the yarn catch ring 16 of the spindle 2b1.

Figure 4E:
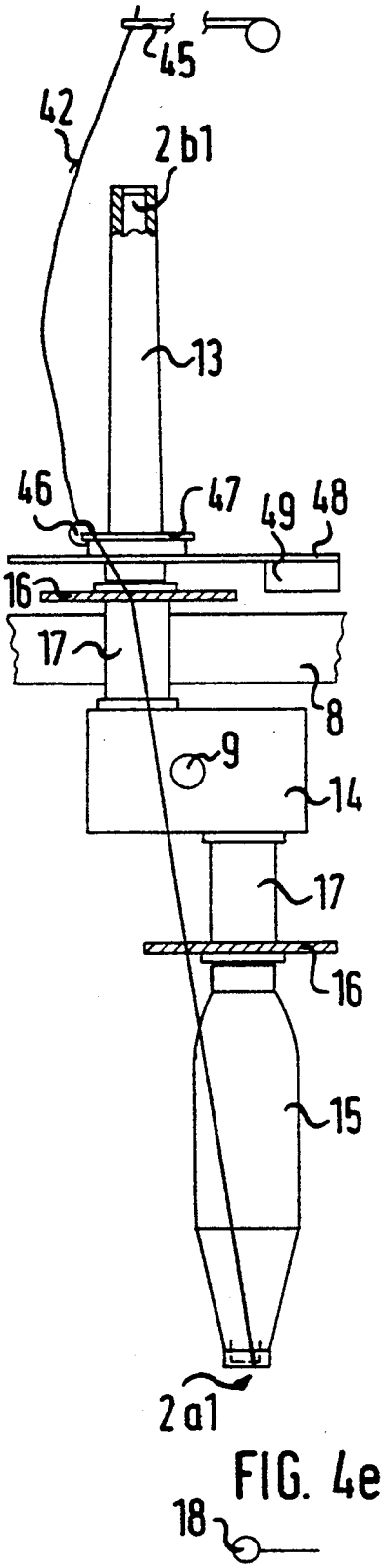

In FIG. 4e, the operation of swiveling the spindles through 180° has been completed. The yarn eyelet 45 is pivoted back again, and the clamping of the roving 42 has been loosened. The pivot shaft 9 is rotated back again, so that the spindle 2b1 enters the spinning position and the spindle 2a1 enters the spooling position. The ring rail 48 is lowered, and the drive wharve 17 of the spindle 2b1 is pressed against the tangential belt 8. The spindle 2b1 begins to rotate, and through the yarn catch ring 16 the diagonally traveling yarn 51' is clamped in place in the catch ring because of the tension created, carried with it, and wound onto the empty spinning tube 13 of the spindle 2b1. At the same time, the yarn is severed, and the spinning operation begins in a known manner with the simultaneous raising and lowering of the ring rail 48.

Figure 4F:
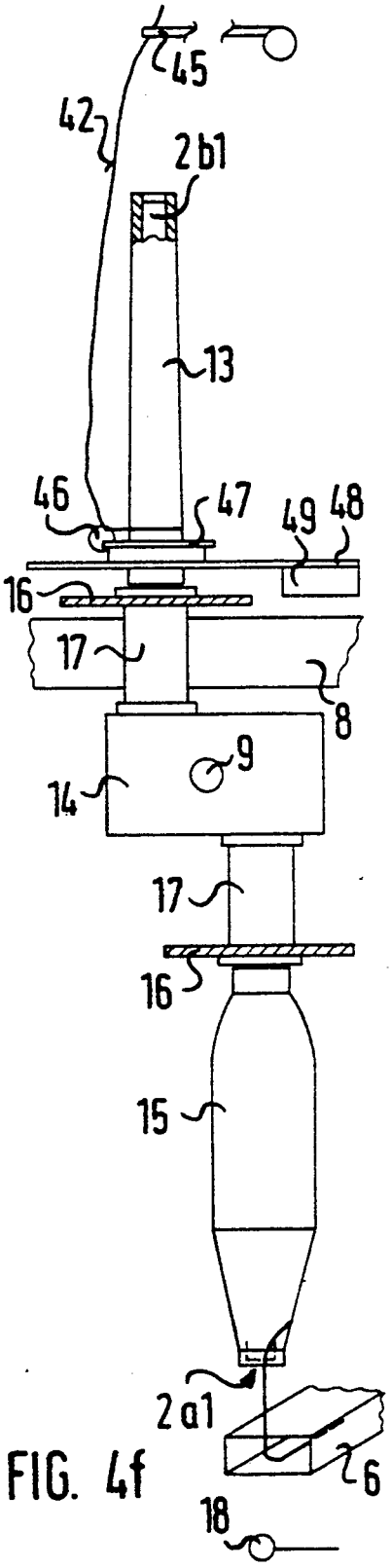

In FIG. 4f, the condition shortly before the startup of the spinning operation is shown. A yarn package 15 is spun onto the spinning tube 13 of the spindle 2b1, while a splicer 6 represented by a yarn suction nozzle, is behind the spindle 2b1 and engages a yarn end trailing from the spinning bobbin so as to prepare it in a known manner for the splicing operation and to join it to the yarn already wound onto the package of the bobbin 20 at the spooling station 31. Once the two yarn ends have been joined, the spooling station is started up again, and the yarn package 15 is unreeled from the spindle 2a1.

The swiveling apparatus 7 described in this embodiment may also have some other kind of structure and need not be actuated from a central control shaft. For instance, it is possible for each pivot shaft 9 to be actuated by its own control device which is adapted only to the particular spinning and spooling station of that spindle pair.

It is also possible to construct the pivoting apparatus in some other way, for instance in such a way that the adjacent spindles are pivoted in a plane through 180° with respect to one another, while remaining stationary. However, this means that the ring rail must be shifted by one spindle position to the right or left after every pivoting operation, unless a separate individual ring rail is provided for each spinning position.

It is also conceivable for a rotation to be effected about an axis in a horizontal plane, after the swiveling of the two spindles in a vertical plane at right angles to the longitudinal axis of the machine, so that one of the positions shown in the exemplary embodiment will be assumed by the spindles each time. Such a pivoting apparatus could be used, for instance, if the spindle pairs are individually controlled.

As can also be seen in FIG. 1, the ring spinning and spooling machine is also equipped with a removal apparatus 60 in the form of a conveyor belt 60 for removing the full cheeses 20. In order to change bobbins at individual spooling stations 31–34, a conventional non-illustrated servicing apparatus for receiving the full bobbins and inserting empty bobbin tubes can move past the spooling stations on a path 61.

It is possible to have the spinning and spooling operations proceed automatically in the ring spinning and spooling machine with the aid of the splicer 6, which may be either a mobile splicer or individual splicers provided at each spooling station, and with the aid of the non-illustrated bobbin changer.

I claim:

1. Ring spinning and spooling frame, comprising spooling stations, bearing plates, a plurality of spindles pointing in opposite vertical directions in pairs on each of said bearing plates, at least two of said pairs of said spindles being associated with one of said spooling stations, said bearing plates being movable in position between a ring spinning position and an unreeling swiveled position of said spindles, and an apparatus carrying said bearing plates, said apparatus pivoting one of said bearing plates through 180° about a horizontal axis out of the vicinity of adjacent bearing plates between said ring spinning position and said unreeling swiveled position of said spindles.

2. Ring spinning and spooling frame according to claim 1, wherein said apparatus includes means for moving said spindles out of an operating position in a row of spindles, means for moving said spindles out of the vicinity of other spindles, means for moving said spindles into another operating position, and means for moving said spindles back into the row.

3. Ring spinning and spooling frame according to claim 1, wherein said spindles are disposed in rows, said apparatus pushes one of said spindle pairs out of one of said rows before pivoting one of said bearing plates, and said apparatus returns said one spindle pair to said one row after pivoting said one bearing plate.

4. Ring spinning and spooling frame according to claim 1, wherein said bearing plates are disposed in rows, said apparatus pushes one of said bearing plates out of one of said rows before pivoting said one bearing plate, and said apparatus returns said one bearing plate to said one row after pivoting said one bearing plate.

5. Ring spinning and spooling frame, comprising spooling stations, bearing plates, a plurality of spindles disposed in pairs on each of said bearing plates, at least two of said pairs of said spindles being associated with one of said spooling stations, said bearing plates being movable in position between a ring spinning position and an unreeling swiveled position of said spindles, an apparatus carrying said bearing plates, said apparatus pivoting one of said bearing plates through 180° out of the vicinity of adjacent bearing plates between said ring spinning position and said unreeling swiveled position of said spindles, and means for actuating said apparatus for displacing and swiveling said bearing plates carrying said spindles, said actuating means being in the form of a control shaft having offset control cams successively acting upon said apparatus at least at one of said spooling stations, said control cams of said control shaft being mutually offset by 120° and operatively connected to said apparatus of every third spindle pair.

6. Ring spinning and spooling frame, comprising spooling stations, bearing plates, a plurality of spindles disposed vertically in pairs on either side of each of said bearing plates, at least two of said pairs of said spindles being associated with and disposed above one of said spooling stations, said bearing plates being movable in position between a ring spinning position and an unreeling swiveled position of said spindles, and an apparatus carrying said bearing plates, said apparatus pivoting one of said bearing plates and said spindles on said one bearing plate in a vertical plane through 180° out of the vicinity of adjacent bearing plates between said ring spinning position and said unreeling swiveled position of said spindles.

7. Ring spinning and spooling frame according to claim 6, including other machine parts, said apparatus pivoting said one bearing plate out of the vicinity of said other machine parts.

8. Ring spinning and spooling frame according to claim 6, including yarn cleaners each being associated with a respective one of said spooling stations, and splicers each being associated with a respective one of said yarn cleaners.

9. Ring spinning and spooling frame according to claim 6, including a removal apparatus for cheeses being associated with said spooling stations.

10. Ring spinning and spooling frame according to claim 6, including pivot shafts each being connected to a respective one of said bearing plates, said spindles of each spindle pair being disposed on one of said bearing plates symmetrically opposite one another with respect to said pivot shaft of said one bearing plate, and said spindles in said spooling position being rotated through 180° under said spindles in said spinning position.

11. Ring spinning and spooling frame according to claim 6, wherein two pairs of said spindles are associated with one of said spooling stations, and only one of said spindles in said spooling position of said two spindle pairs is connected with the associated spooling station for spooling.

12. Ring spinning and spooling frame according to claim 6, wherein each of said spooling stations is disposed beneath and substantially centrally between said spindles in said spooling position associated with said spooling station.

13. Ring spinning and spooling frame according to claim 6, including means for actuating said apparatus for displacing and swiveling said bearing plates carrying said spindles.

14. Ring spinning and spooling frame according to claim 13, wherein said actuating means are in the form of a control shaft having offset control cams successively acting upon said apparatus at least at one of said spooling stations.

15. Ring spinning and spooling frame according to claim 14, including means for causing said control cams to successively act upon groups of said apparatus.

16. Ring spinning and spooling frame according to claim 6, wherein said spindles of said spindle pairs include means for receiving spinning tubes.

* * * * *